US006178870B1

(12) United States Patent
Takahashi

(10) Patent No.: US 6,178,870 B1
(45) Date of Patent: Jan. 30, 2001

(54) FLUID PRESSURE CYLINDER WITH A LOCK MECHANISM

(75) Inventor: Hidehito Takahashi, Tsukuba-gun (JP)

(73) Assignee: SMC Corporation, Tokyo (JP)

( * ) Notice: Under 35 U.S.C. 154(b), the term of this patent shall be extended for 0 days.

(21) Appl. No.: 09/225,243

(22) Filed: Jan. 4, 1999

(30) Foreign Application Priority Data

Jan. 27, 1998 (JP) ..... 10-029235

(51) Int. Cl.[7] ..... F15B 15/26
(52) U.S. Cl. ..... 92/17; 92/21 MR; 92/28
(58) Field of Search ..... 92/15, 17, 21 MR, 92/28

(56) References Cited

U.S. PATENT DOCUMENTS

| | | | | |
|---|---|---|---|---|
| 2,632,425 | * | 3/1953 | Grover | 92/28 |
| 3,203,513 | * | 8/1965 | Allen | 92/28 X |
| 3,359,862 | * | 12/1967 | Modrich | 92/28 X |
| 3,918,346 | * | 11/1975 | Ziegler | 92/28 X |
| 4,981,069 | * | 1/1991 | Matsui | 92/28 |
| 5,216,942 | * | 6/1993 | Sendoykas | 92/17 |
| 5,553,690 | | 9/1996 | Takahashi | 118/300 |
| 5,761,984 | * | 6/1998 | Goellner et al. | 92/28 X |
| 5,791,230 | * | 8/1998 | Goellner | 92/19 |
| 5,823,300 | * | 10/1998 | Higuchi | 92/15 X |

* cited by examiner

*Primary Examiner*—John E. Ryznic
(74) *Attorney, Agent, or Firm*—Oblon, Spivak, McClelland, Maier & Neustadt, P.C.

(57) ABSTRACT

This fluid pressure cylinder with a lock mechanism is adapted to provide, on the lock mechanism cover, an area where valves for controlling the cylinder and lock mechanism can be installed. In the cylinder, a brake shoe grips a piston rod 6 via balls held by a retainer inside a lock mechanism cover 21 using a tapered ring which is driven by a brake spring and returned to its original position by a release piston. A cylinder port 8 that supplies or discharges compressed air to drive the piston is provided on the side of a cylinder 1 inside the lock mechanism cover 21. On the opposite side an unlocking port 34 which leads to a pressure chamber driving a release piston is disposed and a manual opening actuator 45 is provided. This arrangement is intended to ensure a flat area 48 where valves can be installed to control compressed air fed through the ports.

3 Claims, 4 Drawing Sheets

FLUID PRESSURE CYLINDER WITH A LOCK MECHANISM

TECHNICAL FIELD OF THE INVENTION

The present invention relates to a fluid pressure cylinder provided with a lock mechanism which grips a piston rod, thus keeping the rod at rest against fluid pressure.

PRIOR ART

Lock mechanisms have been incorporated in fluid pressure cylinders to stop the piston rod in a certain position. In such a mechanism, a brake shoe is pressed against the piston rod through balls, using a tapered ring whose internal surface is tapered. Using a brake spring, the lock mechanism urges the tapered ring in the direction of braking to lock the piston rod through the balls, thus holding the tapered ring in an unlocking position using a release piston that is driven by lock-release air pressure.

Because a fluid pressure cylinder with such a lock mechanism is driven using air pressure and because its lock mechanism is also deactivated using air pressure, a plurality of air pressure pipe lines with valve control to supply air to the cylinder or discharge it from the cylinder must be connected to the cylinder. If a set of valves controlling many such fluid pressure cylinders are installed and controlled as a unit by a controller, a plurality of air pressure pipe lines are only connected with the fluid pressure cylinders. However, if the cylinders are used separately, if it is necessary to determine which valve corresponds to which fluid pressure cylinder, or if the capacity of the flow channel downstream of a valve needs to be reduced to increase the response of a lock mechanism or the like, the valve should be installed on the fluid pressure cylinder.

However, for a fluid pressure cylinder containing such a lock mechanism as described above, a rod-side cover must be provided with a rod-side cylinder port through which air pressure is supplied or released to drive the piston or with a cushion valve for damping the piston. In addition, the fluid pressure cylinder must be provided with an unlocking port which supplies air pressure to free the piston rod locked by the lock mechanism or with a manual unlocking actuator which is intended to allow the piston rod to be manually unlocked if air pressure for unlocking the piston rod cannot be fed. Furthermore, a bracket must be secured to the cylinder to mount it in an apparatus. Morever, the lock mechanism must be as small as possible. These requirements make it difficult to provide space where the valves can be installed on the rod-side cover of the cylinder with lock mechanism.

SUMMARY OF THE INVENTION

It is an object of the present invention to make it possible to provide space for valves on the rod-side cover of a fluid pressure cylinder with a lock mechanism.

It is another object of the present invention to provide a fluid pressure cylinder with a lock mechanism which features good response and a stable braking force.

To solve the above problems, a fluid pressure cylinder with a lock mechanism according to the present invention is arranged as described below. The cylinder is driven by feeding compressed air through a cylinder port to pressure chambers on both sides of a piston or discharging compressed air from the chambers, and the mechanism locks the piston rod by gripping it.

The lock mechanism is arranged by holding brake shoes inside a lock mechanism cover which stops the piston rod by gripping it, holding a shoe holder which applies a braking force to the brake shoes so that the holder is prevented from moving in the direction of the axis of the piston rod, sliding a release piston into the lock mechanism cover to bring the end surface of a tapered ring located around said shoe holder in contact with the piston surface on the side of the cylinder, making a brake spring act on the release piston around the tapered ring, defining a pressure chamber opposite to the surface of the release piston which is on the side of the cylinder, tapering the internal surface of the tapered ring so that the inner diameter of the ring is larger on the side of the release piston than on the opposite side, disposing many balls, held by a retainer, between the circumference of the shoe holder and the tapered surface, urging the retainer by use of a prepressing spring in such a direction that the balls held by the retainer come in contact with the internal surface of the tapered ring, and providing on the lock mechanism cover a manual opening actuator which presses the release piston from the side of the pressure chamber when operated.

In the fluid pressure cylinder with the lock mechanism, a cylinder port which supplies or discharges compressed air to drive the piston is provided on the cylinder side of the lock mechanism cover, an unlocking port leading to the pressure chamber is disposed opposite to the cylinder side of the lock mechanism cover, the manual opening actuator is installed, and a flat area is ensured around the unlocking port on the lock mechanism cover to install valves which control compressed air fed through the unlocking port.

In a fluid pressure cylinder with a lock mechanism according to the present invention, feeding compressed air through the unlocking port to the pressure chamber on one side of the release piston causes the release piston to be driven against the force of a brake spring by a driving force of compressed air. Thus, the tapered ring does not press the balls, so the brake shoes release the piston rod, thereby freeing the piston rod from the lock mechanism. Discharging compressed air through the unlocking port from the pressure chamber causes the release piston to be returned to the side of the pressure chamber by the force of the brake spring. At the same time, the tapered surface of the tapered spring presses the balls, which in turn press the brake shoes through a shoe holder against the piston rod, thus locking the piston rod.

Since the release piston is provided on the side of the outer end of the lock mechanism cover, as is the pressure chamber that drives the release piston, a cylinder port through which compressed air is fed or discharged to drive the piston and a cushion valve for damping the piston can be disposed near the cylinder on the lock mechanism cover, and the unlocking port through which compressed air is supplied to unlock the piston rod and a manual opening actuator can be installed on the side of the outer end of said cover. This in turn means that the ports can be dispersed on the lock mechanism cover, so that a flat area in the viinity of the unlocking port can be provided for valves that control the cylinder and lock mechanism. This includes an area on the lock mechanism cover near the cylinder port for istalling the valves. As a result, a fluid pressure cylinder with a lock mechanism can be provided wherein it is advantageous if the cylinder is used separately, if it is necessary to determine which valve corresponds to which fluid pressure cylinder, or if the response of the lock mechanism needs to be increased.

In the lock mechanism, the brake shoes and shoe holder are provided inside the lock mechanism cover so that the shoes and holder can slide radially; the tapered ring and retainer are floated radially; many receiving pockets receiving the balls are provided in two rows around the retainer, the receiving pockets on the side of the release piston receiving balls of a large diameter and those on the opposite side receiving balls of a small diameter; and an elastic ring is wound in a V-shaped groove formed on one side of the outer circumference of the two rows of pockets around the retainer to prevent the balls from falling off and urge them in the direction tangential to the outer circumference of the shoe holder, so that a well-balanced, highly responsive, and stable braking force can be applied to the piston rod according to its eccentricity.

Such a fluid pressure cylinder with a lock mechanism according to the present invention makes it possible to ensure on the lock mechanism cover an area for installing valves to control the cylinder and lock mechanism. This configuration is advantageous if the cylinder is used separately, if it is necessary to determine which valve corresponds to which fluid pressure cylinder, or if the response of the lock mechanism needs to be increased. The present invention provides a fluid pressure cylinder featuring a highly responsive lock mechanism and a highly stable braking force.

DESCRIPTION OF THE EMBODIMENTS

Figure 1:
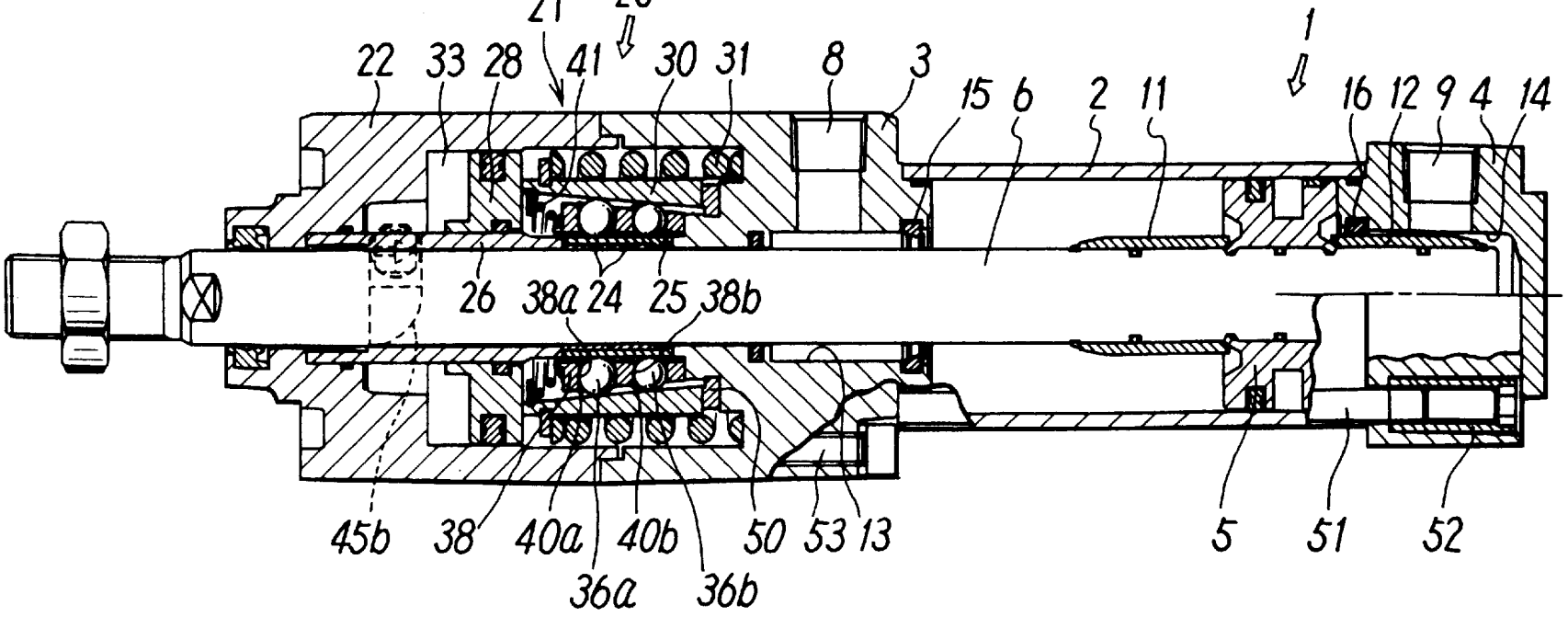
FIG. 1 is a cross-sectional view of an embodiment of a fluid pressure cylinder with a lock mechanism according to the present invention.

FIGS. 1 through 4 show an embodiment of a fluid pressure cylinder with a lock mechanism according to the present invention. The cylinder 1 has a cylinder tube 2, a rod cover 3, and a head cover 4, which are installed at both ends of the cylinder tube 2, a piston 5 that slides into the tube 2, and a piston rod 6 connected with the piston 5 and led out through the rod cover 3. The cylinder is intended to feed compressed air to pressure chambers on both sides of the piston 5 or discharge it from the chambers through cylinder ports 8 and 9, which are provided in the rod cover 3 and head cover 4 respectively.

The cylinder 1 also has a known air cushion mechanism which damps the piston 5. That is, cushion rings 11 and 12 are fitted over the piston rod 6 on both sides of the piston 5, and recesses 13 and 14 which the cushion rings 11 and 12 fit into together with the piston rod 6 at the end of a stroke are formed in the rod cover 3 and head cover 4 respectively. Cushion packings 15 and 16 which seal the space between the cushion rings 11 and 12 and the recesses when the cushion rings fit into the recesses 13 and 14 are fitted at the inlet edges of the recesses. Cylinder ports 8 and 9, through which compressed air is fed to or discharged from the pressure chambers on both sides of the piston 5, communicate through the recesses 13 and 14 with their respective pressure chambers. Cushion channels (not shown) are also provided. These channels communicate through cushion valves 17 and 18 in FIGS. 2 and 3 with the cylinder ports 8 and 9.

Figure 3:
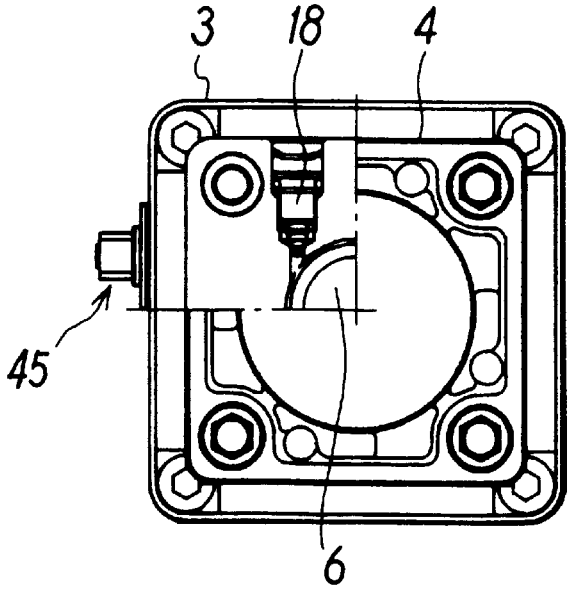
FIG. 3 is a partial transverse cross-sectional view of an arrangement of a manual unlocking actuator in the embodiment.
Figure 4:
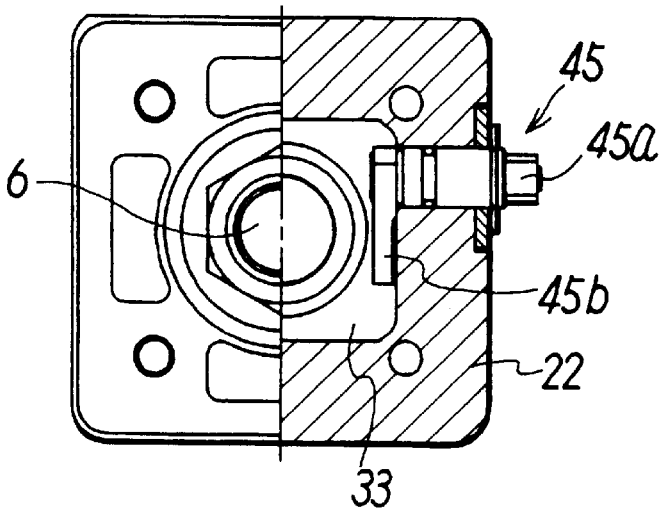
FIG. 4 is a partial transverse cross-sectional view of an arrangement of a cushion valve in the embodiment.

A lock mechanism 20 installed on the cylinder 1 has an end cover 22 that forms a lock mechanism cover 21 integrally with the rod cover 3. The piston rod 6 in the cylinder 1 is adapted to hermetically pass through the cover 21 at the center thereof through a seal, thus leading outside. As seen in FIGS. 3 and 4, the lock mechanism cover 21, that is, the rod cover 3 and end cover 22, are formed into a nearly rectangular pipe integrally with the head cover 4, so that the tops of the rod cover 3 and end cover 22 are made flat to enable the valve 60 in FIGS. 5 and 6 to be installed.

By forming a slit in part of a cylindrical member placed around the piston rod 6, brake shoes 24, which grip the piston rod 6 between the rod cover 3 and end cover 22 to stop the rod, are arranged so that their diameter can be reduced. Similarly, a shoe holder 25, which holds the brake shoes 24 inside and applies a braking force to them, is provided with a slit so that its diameter can be reduced to hold the shoes 24 on the internal surface. The brake shoes 24 and shoe holder 25 are housed between the area around the rod hole in the rod cover 3 and the piston guide 26 held by the end cover 22. In this way, the piston rod cannot move axially (i.e., in the thrust direction) but it can slide radially.

A circumferential surface of the piston guide 26 is formed as a smooth sliding surface over which a release piston 28 hermetically slides via a seal. A release piston 28 is hermetically slid between the inner-circumferential surface of the end cover 22 and the circumferntial surface of the piston guide 26. In the release piston 28, an end surface of a tapered ring 30, which extends toward the side of the cylinder 1 (the side of the rod cover 3) and is placed around the shoe holder, contacts a surface on the side of the cylinder 1. Around the tapered ring 30, the release piston 28 also compresses a brake spring 31 between a stop ring, fitted over the tapered ring 30, and a spring receiver on the side of the rod cover 3 to urge the release piston 28 toward the side of the end cover 22, that is, in the direction in which brakes are applied. The tapered ring 30, whose internal surface is tapered so that the internal diameter of the ring is larger on the side of the release piston 28 than on the opposite side, is not prevented from moving radially but floats with its end surface in contact with the tapered ring 30.

A pressure chamber 33 is formed on the side of the release piston 28 which is opposite to the cylinder 1, that is, between the release piston 28 and the end cover 22. By feeding compressed air to the pressure chamber 33, the release piston 28 is urged toward the side of the rod cover 3 against the urging force of the spring 31 (thereby unlocking the release piston). To this end, an unlocking port 34 (FIG. 2) that communicates with the pressure chamber 33 is provided on the end cover 22. The space between the release piston 28 and the rod cover 3 is opened to the outside via a ventilation port (not shown) formed on the rod cover 3.

Many pockets 38*a* and 38*b* which receive balls 36*a* and 36*b* are provided in tow rows around a retainer 38, holding the balls 36*a* and 36*b* around the shoe holder. The receiving pockets 38*a* on the side of the release piston 28 receive the balls 36*a* of a large diameter, and the receiving pockets 38*b* on the opposite side receive the balls 36*b* of a small diameter to bring the balls 36*a* and 36*b* in the respective pockets 38*a* and 38*b* in contact with the surface of the shoe holder 25 and make the balls 36*a* and 36*b* opposite to the internal surface of the tapered ring 30. Forming the retainer 38 from synthetic resin into one piece makes the pitch between the balls constant, thus enabling them to position correctly.

A V-shaped groove is formed on one side of the outer circumference of each of the two rows of pockets 38*a* and 38*b* in the retainer 38. Elastic rings 40*a* and 40*b* are wound around the V-shaped grooves to prevent the balls from falling off and to always urge the large and small balls in such a direction that they come in contact with the outer circumference of the shoe holder 25. A prepressing spring 41 that is coiled into a cone is disposed under compression between the retainer and a stop ring installed in an internal groove of the tapered ring 30. The spring 41 is used to urge the retainer 38 and the balls 36*a* and 36*b* held by the retainer in such a direction that the retainer and balls press the internal surface of the tapered ring 30.

To make it possible to unlock the piston rod 6 manually in the case of a power outage or other accident, in which no compressed air is supplied from a compressed air source. A manual opening actuator 45 which allows the release piston 28 to be pressed from the side of the pressure chamber 33 by operation from outside the end cover 22 is disposed as shown in detail in FIGS. 1 and 4. The manual opening actuator 45 has an operation head 45*a* which hermetically projects outside the end cover 22 and can be turned using a commercially available tool and has a cam 45*b* which presses the release piston 28 in the pressure chamber 33 due to rotation of the operation head 45*a*. The actuator is arranged so that it keeps the piston rod 6 unlocked while the cam 45*b* presses the release piston 28 due to rotation of the operation head 45*a* and so that the urging force of the brake spring 31 causes the cam 45*b* to return to its original position, thus actuating the lock mechanism again when the operation head 45*a* stops rotation.

Figure 2:
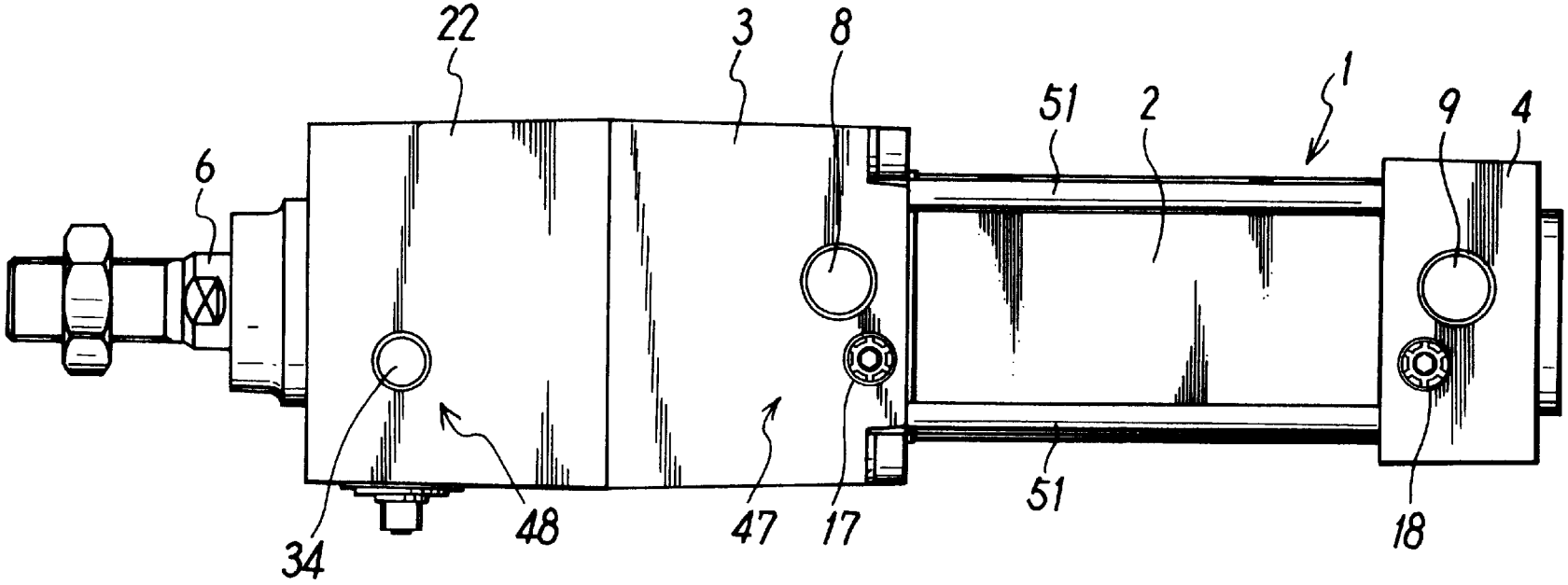
FIG. 2 is a plan view of the embodiment.

As described above, a rod-side cylinder port 8 through which compressed air is fed or discharged to drive the piston 5, a cushion valve 17 for damping the piston 5, an unlocking port 34 through which compressed air is supplied to unlock the piston rod 6, and the manual opening actuator 45 which is used if compressed air for unlocking the piston rod 6 cannot be fed are installed on the lock mechanism cover 21 as shown in FIG. 2 in detail. Since the release piston 28 is provided on the side of the end cover 22 and the pressure chamber 33 to which compressed air is fed to drive the release piston 28 is installed in the outer end side of the lock mechanism cover 21, it is natural that the unlocking port 34 and manual opening actuator 45 should be disposed on the outer end side of the end cover 22 and that the cylinder port 8 and cushion valve 17 should be disposed near a cylinder tube 2 inside the rod cover 3.

Figure 5:
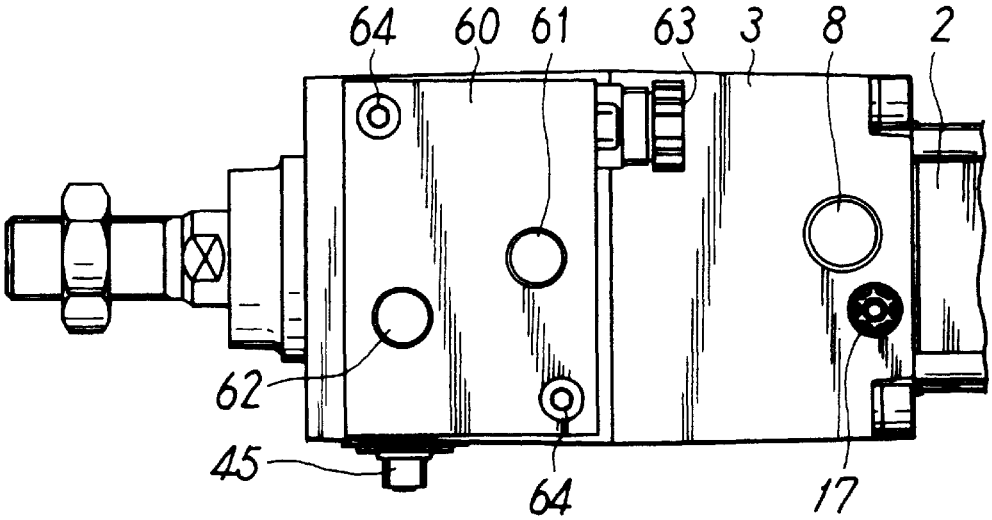
FIG. 5 is a major-component plan view of the fluid pressure cylinder with a lock mechanism, wherein the cylinder is provided with a valve.
Figure 6:
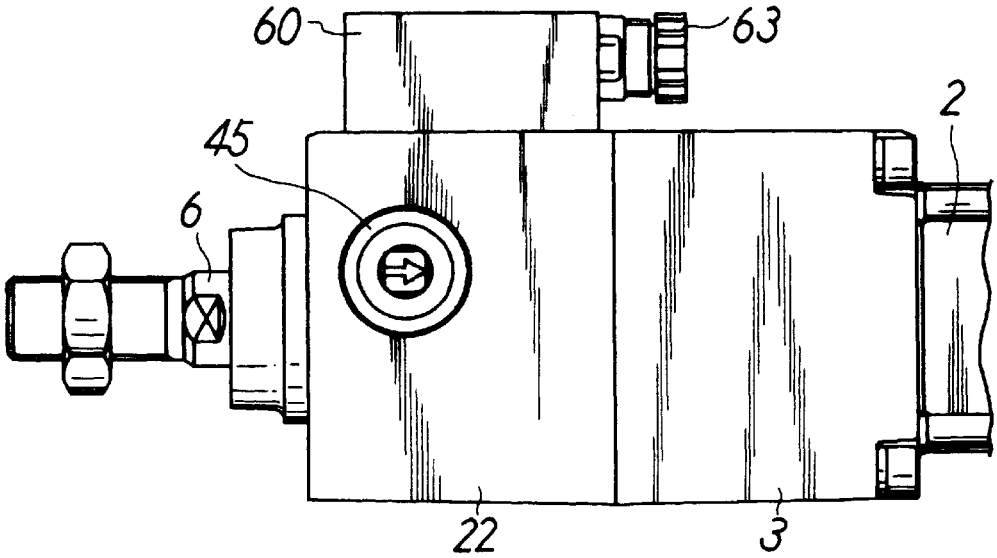
FIG. 6 is a major-component side view of the fluid pressure cylinder with a lock mechanism, wherein the cylinder is provided with a valve.
Figure 7:
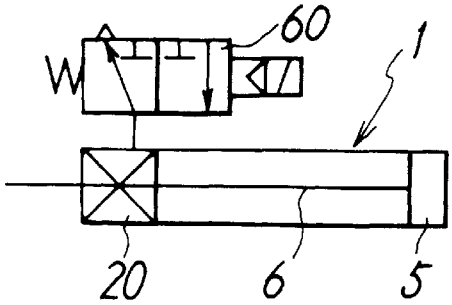
FIG. 7 is an illustration with symbols to show connections between the fluid pressure cylinder and the valve.

Thus the ports are dispersed over the lock mechanism cover 21, which disposition, coupled with the fact that the lock mechanism covers 21, that is, the rod cover 3 and end cover 22, are formed into a nearly rectangular pipe, makes it possible to provide in the vicinity of the unlocking port 34, including an area near the cylinder port 8 on the lock mechanism cover 21, a flat area 48 where switch-over valves controlling the cylinder 1 and lock mechanism 20 can be installed. As shown in FIGS. 5 and 6, a switch-over valve 60 can be installed in the flat area. The switchover valve 60, consisting of an electromagnetically driven 3-port valve whose output port is connected to the unlocking port 34 of the lock mechanism 20 as shown in FIG. 7, is switched to feed compressed air to the unlocking port 34 from a pressure resource when the switch-over valve 60 is energized. Compressed air is discharged through the unlocking port 34 from pressure chamber 33 when the valve 60 is deenergized.

In FIGS. 5 and 6, numerals 61 and 62 denote the feed port and discharge port of the switch-over valve 60, respectively; numeral 63 denotes an energizing connector for driving the switch-over valve 60; and 64 denotes a set screw used to secure the valve 60 to the end cover 22.

Installing the switch-over valve 60 in such a manner is advantageous if the cylinder is used separately, if it is necessary to determine which valve corresponds to which fluid pressure cylinder, or if the response of the lock mechanism needs to be increased. The same is true of the head cover 4. Because no lock mechanism is provided on the side of the head cover 4, no particular problem arises. With regard to fixing the bracket to install the fluid pressure cylinder with a lock mechanism on an apparatus, it is difficult to use the bottom or the end surfaces of the covers at both ends in order to secure an area where the valve 60 is installed. On the other hand, it is inappropriate to install a valve away from ports 8 and 34.

In the figure, numeral 50 denotes a damper which the tapered ring 30 comes in contact with when pressed by the release piston 28; numeral 51 is a tie rod connecting the cylinder tube 2, rod cover 3, and head cover 4; numeral 52 denotes a tie rod nut; and numeral 53 is a fastening bolt jointing the rod cover 3 and end cover 22.

Operation of the fluid pressure cylinder with a lock mechanism is described below.

FIG. 1 shows the fluid pressure cylinder, with compressed air for unlocking being fed through the unlocking port 34 into the pressure chamber 33. Since compressed air supplied to the pressure chamber 33 presses the release piston 28 against an urging force of the brake spring 31 until the piston 28 reaches its stroke end on the side of the rod cover 3, the tapered ring 30 is pressed against the damper 50, and the end of the retainer 38 is also pressed against the rod cover 3. The tapered ring 30 is not pressed against the balls 36*a* and 36*b* held by the retainer 38, so the brake shoes 24 release the piston rod 6, and the lock mechanism 20 unlocks the rod 6.

When compressed air is discharged through the unlocking port 34 from the pressure chamber 33, the force of the brake spring 31 causes the release piston 28 to return to the side of the pressure chamber 33. At the same time, the internal surface of the tapered ring 30 presses the balls 36*a* and 36*b*, thus pressing the brake shoes 24 against the rod 6 via the balls. In this case, the release piston 28 and tapered ring 30 are separated from each other, the ring 30 is not prevented from moving radially but kept floated, and the brake shoes 24 and shoe holder 25 are installed so that the shoes and holder can slide radially. Thus, a well-balanced braking force can be applied to the piston rod 6 according to its eccentricity. Prepressing the retainer 38 and the balls 36*a* and 36*b* held by the retainer 38 by means of a prepressing spring 41 minimizes the clearance among the piston rod 6, the brake shoes 24, the shoe holder 25 and the balls, and enables the balls on the shoe holder 25 to roll without failure, thus applying a braking force instantly.

Because of its structure, the fluid pressure cylinder with a lock mechanism is formed such that a braking force acting in the direction in which the piston rod 6 projects is larger than that acting in the reverse direction. For the cylinder 1 in the figure, with the piston rod 6 projected on one side, the difference in area between the pressure chambers on both sides of the piston 5 causes a driving force on the side of projection of the piston rod 6 to be larger than that on the opposite side. As a result, the lock mechanism 20 corresponds to such a driving force of the piston 5. The present invention, however, is not limited to a piston whose piston rod projects on one side.

For the fluid pressure cylinder with a lock mechanism, it is desirable that the tapered ring 30 be formed from a single material to increase its accuracy, that the accuracy (surface roughness, deviation from circularity, deviation from cylindricity, etc.) of the shoe holder 25 be increased, and that the inclination angle for the tapered ring 30 be equal to or larger than the angle of friction.

What is claimed is:

1. A fluid pressure cylinder with a lock mechanism, comprising a piston sliding in a cylinder tube in response to operation of air pressure, pressure chambers on both sides of the piston, two cylinder ports separately communicating with the respective pressure chambers, a piston rod extending from the piston through a lock mechanism cover on one end of the cylinder tube, and a lock mechanism provided in the lock mechanism cover;

wherein the lock mechanism includes brake shoes surrounding an outer periphery of the piston rod, a shoe holder for holding the brake shoes, a retainer fitted at an outside of the shoe holder, a plurality of balls held in pockets of the retainer and in contact with an outer face of the shoe holder, a tapered ring fitted at an outside of the retainer and having on an inner side the rest a tapered face in contact with the balls, a brake spring elastically urging the tapered ring toward a locked position where the balls are pressed against the shoe holder by the tapered face, a release piston connected for causing the tapered ring to return to an unlocked position against the brake spring, a pressure chamber formed on one side of the release piston, an unlocking port for feeding compressed air to the pressure chamber, and a manual actuator connected for causing the release piston to return to the unlocked position by manual operation; and wherein one of the two cylinder ports is provided to an end portion of the lock mechanism cover thereof on a side to which the cylinder tube is connected, the unlocking port and the manual actuator are provided to an end portion of the lock mechanism cover opposite to the side provided with the cylinder port of the lock mechanism cover, and a flat area is provided around the unlocking port so that the valves can be installed to control compressed air fed through the unlocking port.

2. A fluid pressure cylinder with a lock mechanism according to claim 1, wherein the brake shoes and shoe holder are provided around the piston rod so that the shoes and holder can be displaced radially and the tapered ring and retainer are disposed in a radially floating state; and the retainer has a plurality of pockets of a large diameter and a plurality of pockets of a small diameter provided in two rows to surround the retainer, the balls held in the pockets of large diameter being larger than the balls held in the pockets of the small diameter, a V-shaped groove is formed near one end of each of the pocket rows on an outer periphery of the retainer, and an elastic ring is mounted to the V-shaped groove to prevent the respective balls from falling and to press the balls in the direction tangential to the shoe holder.

3. A fluid pressure cylinder with a lock mechanism according to claim 1 or 2, further comprising a switch-over valve which feeds compressed air to the unlocking port, installed in an installing area formed on the lock mechanism cover.

* * * * *